United States Patent [19]

Joosten

[11] Patent Number: 4,667,494

[45] Date of Patent: May 26, 1987

[54] TOOL SET AND METHOD FOR OPENING AND DECODING LOCKS

[76] Inventor: Douglas W. Joosten, 13513 Auburn NE, Albuquerque, N. Mex. 87112

[21] Appl. No.: 818,364

[22] Filed: Jan. 13, 1986

[51] Int. Cl.[4] ..... E05B 19/20

[52] U.S. Cl. ..... 70/394; 33/540; 81/15.9; 81/488

[58] Field of Search ..... 70/394, 364 R, 397–399; 33/539, 540; 81/15.9, 488

[56] References Cited

U.S. PATENT DOCUMENTS

| | | | |
|---|---|---|---|
| 135,600 | 2/1873 | Seibert | 70/397 |
| 947,913 | 2/1910 | Jenkins | 70/399 |
| 1,863,525 | 6/1932 | Long | 70/395 |
| 2,066,645 | 1/1937 | Rial | 33/540 |
| 2,338,768 | 1/1944 | Johnstone | 70/394 |
| 3,827,151 | 8/1974 | Naill | 70/394 X |
| 3,985,010 | 10/1976 | Idoni | 70/364 A |
| 3,987,654 | 10/1976 | Iaccino et al. | 70/364 |
| 4,006,613 | 2/1977 | Zion | 70/394 |
| 4,185,482 | 1/1980 | Nail | 70/394 |

FOREIGN PATENT DOCUMENTS

| | | | |
|---|---|---|---|
| 374673 | 4/1923 | Fed. Rep. of Germany | 70/399 |
| 633936 | 8/1936 | Fed. Rep. of Germany | 70/398 |

*Primary Examiner*—Robert L. Wolfe
*Assistant Examiner*—Lloyd A. Gall
*Attorney, Agent, or Firm*—Donald P. Smith

[57] ABSTRACT

A tool set and a method of opening and decoding a side bar lock employing wafer type tumblers. A spring compressor tool configured for insertion into the lock mechanism keyway raises all the tumblers to a radially outward position and compresses the springs that normally bias the tumblers inwardly. A spring retainer tool inserted into the keyway with the spring compressor tool engages the tumbler springs to retain the springs in a compressed position but frees the tumblers for movement. A tumbler adjusting tool is inserted to grasp the tumblers, and move the tumblers to a position where the lock mechanism can be opened. A decoding tool is inserted to measure the radial position of each tumbler and provide a number which can be used to make a new key. A dust cover holding tool is provided to hold open the spring actuated dust cover.

4 Claims, 17 Drawing Figures

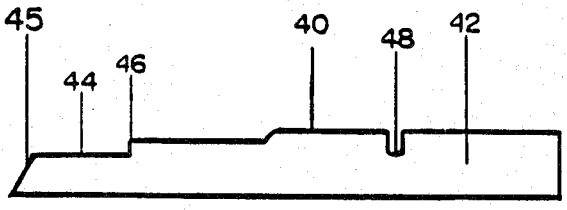
FIG. 4
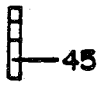
FIG. 4a
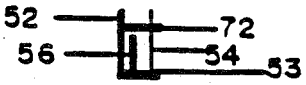
FIG. 5a
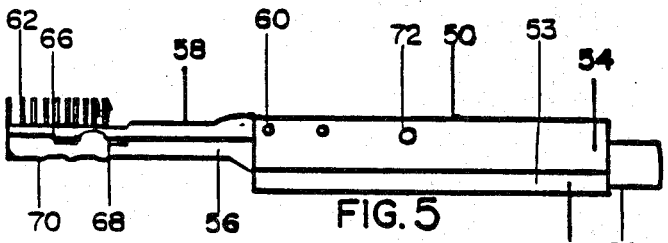
FIG. 5
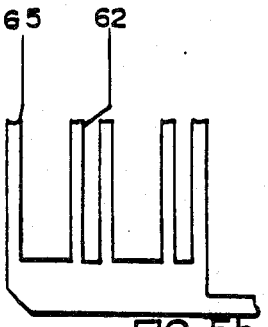
FIG. 5b
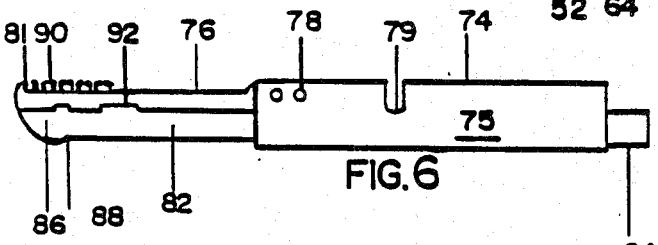
FIG. 6
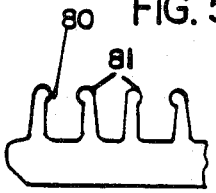
FIG. 6a
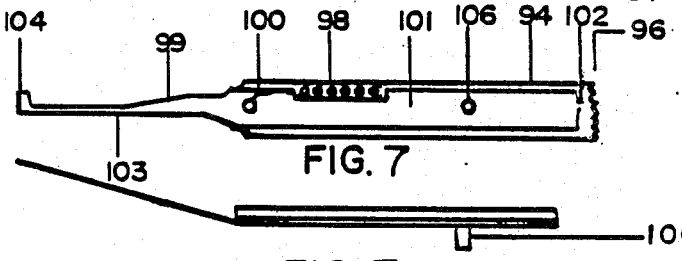
FIG. 7
FIG. 7a
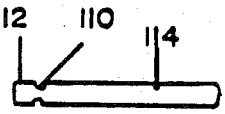
FIG. 8
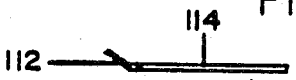
FIG. 8a

TOOL SET AND METHOD FOR OPENING AND DECODING LOCKS

BACKGROUND OF THE INVENTION

1. Field of the Invention

The field of this invention is a method and apparatus for opening and decoding lock mechanisms. More particularly, the invention is an apparatus or tool set for opening and decoding side bar lock mechanisms that utilize wafer type tumblers. Lock mechanisms of this type have been manufactured for many years by the Briggs and Stratton Company, and they are used on many General Motor Corporation cars.

2. Description of the Prior Art

A side bar lock mechanism of the wafer tumbler type is illustrated and described in U.S. Pat. No. 4,185,482, issued to William B. Nail. The Nail patent discloses a tool that allegedly can be used for determining the bittings of a key that will open a side bar lock employing wafer type tumblers. The Nail device can also be used for opening such locks when a key is lost. The lock mechanism disclosed in the Nail patent has only five (5) wafer type tumblers whereas modern lock mechanisms as used in General Motor automobiles employ six (6) tumblers with a fixed spacing along the longitudinal axis of the lock mechanism, but only five (5) different tumbler positions. Information as to the spacing of the tumblers, the number of tumblers employed and other dimensions of the lock mechanisms for General Motor's automobiles are available to professional locksmiths. The only information that is not readily available to a locksmith is the position that each tumbler must occupy for opening a particular lock. Even information as to tumbler depth or alignment is available if the locksmith has the identification number of the lock.

There can be relative rotation of the parts of locks of this type when the V-notches in the tumblers are aligned so as to accept a leading end of the side bar. This allows the side bar to retract into the lock cylinder under the urging of a spring and thereby permit rotation of the lock cylinder relative to the cylindrical casing in which it is mounted. The V-notches are normally aligned by the key so a lock-picking tool to readily accomplish this same function when a key is lost is needed. It is also very desirable to be able to replace the lost key, so it is important to provide a tool capable of providing information for this purpose.

A locksmith can make a new ignition key for a General Motor's automobile if he knows the idenitfication number of the lock. However, most owners do not have this information, and it is becoming more difficult to obtain the information from the automobile dealer, even when known, who sold the automobile when new. Some dealers no longer retain this type of information. The ignition lock identification number is usually found on the casing of the ignition lock mechanism, but access to this number is not a simple matter when the ignition is locked and the key may be lost. Gaining access to the number requires removal of the steering wheel and other apparatus associated with the steering column locking device, so this approach can be expensive and time consuming for the automobile owner.

One approach utilized to open a side bar lock is to drill the lock cylinder so that a wire or pin can be inserted into the lock in a position to exert considerable radially inward pressure on the side bar. This causes the leading edge of the side bar to bear against the tumblers with more pressure than normal, so when a locksmith manipulates each tumbler with a pick, it is easier to align the V-notches in the tumblers with the side bar so that the lock can be opened. Of course, the problem with this approach is that the lock is ruined by the drilling and must be replaced. If the lock is ruined in an automobile door, then replacing the lock is a labor-intensive and expensive job because the inside door paneling, handles and controls must be removed to gain access to the interior.

There are also rocker type tools which can be used to pick side bar locks. These tools have arcuate-shaped picking sections that are inserted into the lock and rocked up and down while attempting to turn the lock cylinder in its casing. If a locksmith is fortunate, he may open a lock after using one of these tools for awhile. More often than not, he will spend considerable time trying these tools, and then have to resort to some other method such as drilling to open the lock.

SUMMARY OF THE INVENTION

A principal object of the invention is to provide a method and apparatus for easily opening a lock mechanism without damaging the lock mechanism.

It is another object of this invention to provide a tool set that can be used to rapidly and easily open a side bar lock mechanism employing wafer type tumblers when the key has been lost.

Another important object of the invention is to provide a tool set that can be employed to decode the bittings of a key that will operate the lock mechanism.

These and other objects of the invention are accomplished by skillful and professional use of a tool set constructed in accordance with this invention. The tool set disclosed herein consists of several basic tools that when utilized in proper sequence will open and decode a lock mechanism of the type described herein. The tool set includes a spring compressor, a spring retainer, a tumbler grasping instrument and a decoding tool. The tool set also includes a dust cover tool for holding open the dust cover used on the door and trunk locks during the picking and decoding operation. This tool is useful because the dust cover urging against the picking and decoding tools makes the operation more difficult to accomplish. The spring compressor has an end section formed like a blank key. This end section is first inserted into the lock mechanism keyway, just like a key would normally be inserted, to force all the tumblers into their radially outward position and compress the springs that normally bias the tumblers inwardly. The spring retainer is then inserted into the lock mechanism adjacent the spring compressor and adjusted manually so that a portion thereof having comb-like teeth engages the springs that normally bias the tumblers inwardly. The spring retainer includes a slide bar that slides into the keyway and supports the comb-like teeth in a position to retain the tumbler biasing springs in a compressed position.

The spring compressor is then removed from the lock mechanism and a tumbler-grasping instrument is installed into the keyway adjacent the spring retainer. The tumbler-grasping instrument has a plurality of finger-like projections that can be manipulated manually by a locksmith so that the projections slide over and hold the tumblers. Further rocking motion of the tumbler-grasping instrument adjusts the position of the tumblers so that the lock mechanism side bar can retract into V-notches formed in the tumblers and allow the lock mechanism to be rotated to an on position in the case of an automobile ignition switch. If the lock mechanism is used in conjunction with a door opening mechanism, then rotation of portions of the lock mechanism will result in movement of the linkage employed in such door opening mechanisms to open the lock door.

When the lock mechanism is in an on or open condition, the lock mechanism side bar is retained in the tumbler V-notches by an outer casing portion of the lock mechanism. In this condition, the tumbler-grasping instrument is removed from the lock mechanism, and the decoding tool is installed in the lock mechanism with the spring retainer still in place. The decoder tool is aligned at six different positions, one for each tumbler in the lock mechanism, and then a feeler device is manually moved until it engages the tumbler being felt. The decoder tools includes an indicator that indicates how much movement of the feeler device was necessary to contact the tumbler. The indicator is calibrated and provides a number that a locksmith can use to set a key making machine and make a replacement key.

BRIEF DESCRIPTION OF THE DRAWINGS

FIG. 4 is a side elevation of the spring compressor.

FIG. 4*a* is an end view of FIG. 4 looking at the spring compressor from the left side of the drawing.

FIG. 5 is a side view of the spring retainer.

FIG. 5*a* is an end view of FIG. 5 viewed from the left side of the drawing.

FIG. 5*b* is an enlarged view of comb-like projections of the spring retainer that maintain the tumbler biasing springs in a compressed position while the lock mechanism is being opened and decoded.

FIG. 6 is a side view of the tumbler-grasping instrument.

FIG. 6*a* is an end view of the instrument shown in FIG. 6 as view from the left side of the drawing.

FIG. 7 is a side view of the decoder tool.

FIG. 7*a* is a top view of the decoder tool shown in FIG. 7 as viewed from the direction of the top of the drawing.

FIG. 8 is a view in elevation of the dust cover holding tool.

FIG. 8*a* is a side view of FIG. 8 as viewed from the left side of the page.

DETAILED DESCRIPTION OF THE INVENTION

Figure 1:
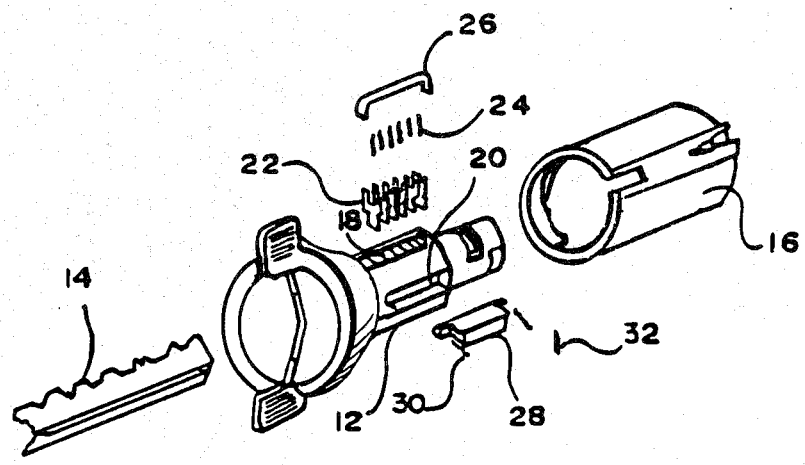
FIG. 1 is an exploded view of a typical side bar lock mechanism.

Referring now to the drawings, FIG. 1 discloses a typical side bar lock mechanism that is used as the ignition lock on General Motor's automobiles. The lock mechanism includes a lock cylinder 12, a key 14 for insertion into the lock cylinder and an outer cylindrical casing 16 in which the lock cylinder is rotatably mounted. Lock cylinder 12 is formed with an internal cavity that includes tumbler guideways 18, and a side bar guideway 20. A plurality of flat tumblers 22 are slideably mounted in the guideways 18, and these tumblers are normally biased radially inwardly by springs 24. Springs 24 are retained in the cylinder by retainer 26. A side bar 28 is slideably mounted in guideway 20 so that its direction of motion is perpendicular to that of tumblers 22. Side bar 28 is biased radially inwardly by springs 30 which are retained in the lock cylinder by retainers 32.

Figure 2:
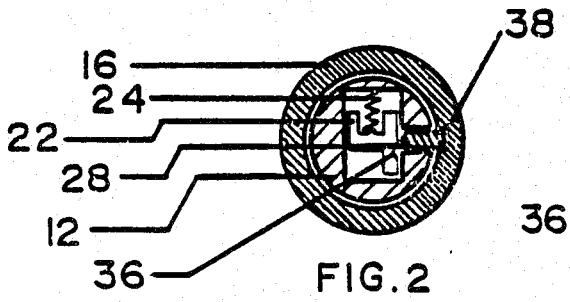
FIG. 2 is a cross-sectional view of a lock mechanism like that shown in FIG. 1 with the lock cylinder immobilized relative to the outer casing because the side bar extends into a groove in the outer casing. The side bar is held in the groove by a tumbler whose V-notch is below the side bar.
Figure 3:
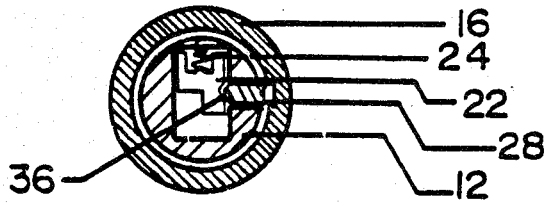
FIG. 3 illustrates the tumblers in a position where the side bar has been accepted into the tumbler V-notch.

Referring now to FIGS. 2 and 3, the operation of this conventional lock mechanism will be briefly described. In FIG. 3, key 14 is inserted in the keyway so that the key engages the lower surface of tumbler 22 and forces the tumbler radially outward against the action of springs 24. The key has forced the tumbler to a position where V-notch 36 formed in the tumbler receives the leading edge of the side bar 28. In this position, the lock cylinder can be rotated relative to the outer casing 16 and move the ignition switch to an on position. FIG. 2 illustrates the tumbler position when there is no key inserted in the keyway. When the ignition has been turned to the off position and the key withdrawn, then springs 24 exert enough radially inward force on tumblers 22 so that the V-notches force the side bar outwardly to a position where it slides into recess 38 formed on the interior of casing 16. When the key is reinserted in the keyway, then the tumblers are positioned so that the V-notches are all aligned to receive the lead end of the side bar. In this condition, the springs 30 force the side bar into the V-notches and out of recess 38 thereby permitting relative rotation between lock cylinder 12 and casing 16.

Figure 9:
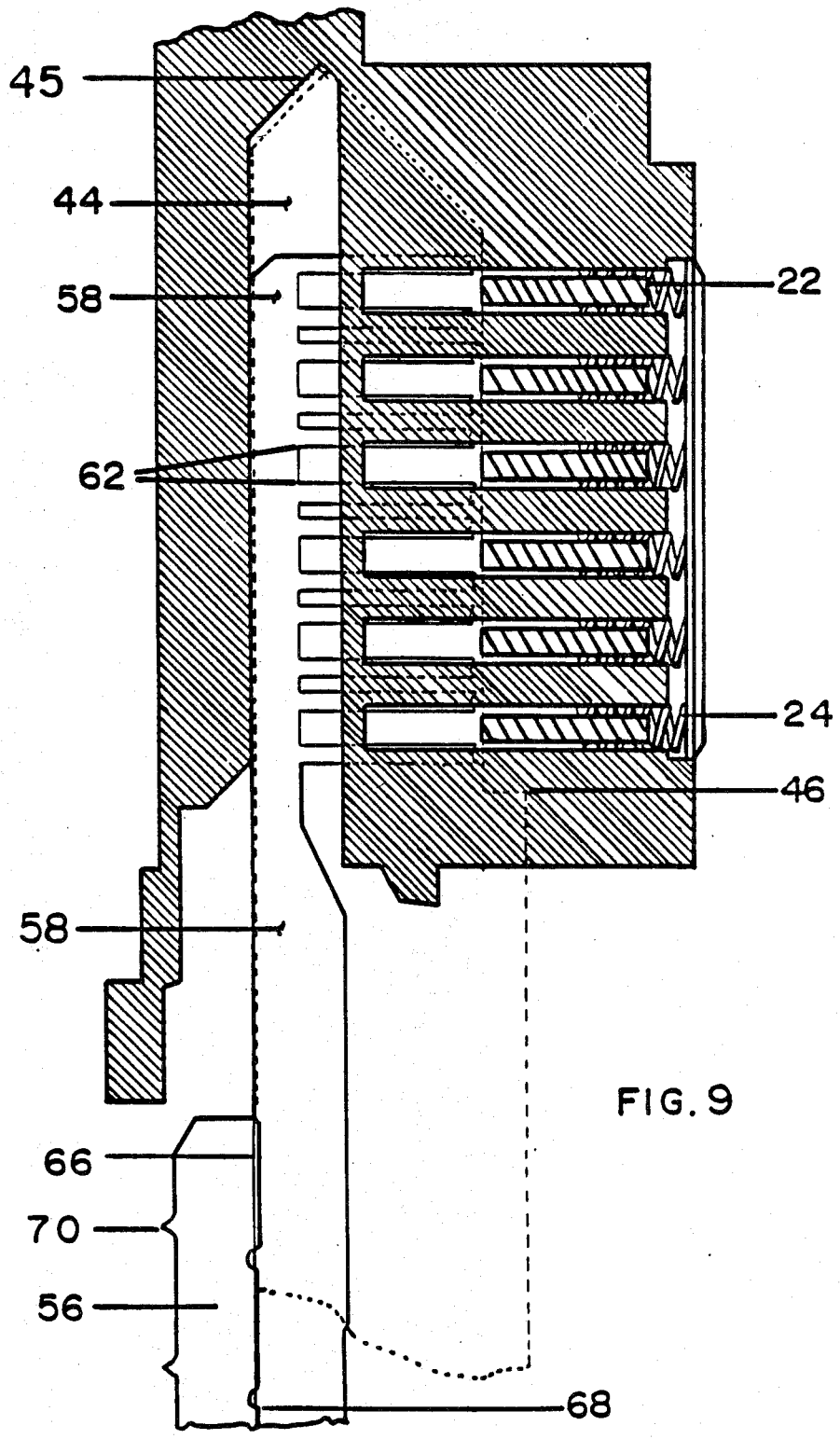
FIG. 9 is a cross-sectional view of a lock cylinder of a side bar lock mechanism with the spring compressor in place and the spring retainer inserted in the keyway but not moved to a tumbler spring engaging position.

FIGS. 4 through 8 disclose the five tools that are included in a tool set that is particularly adapted for side bar lock mechanisms of the type described. As will become more evident as this description progresses, these five tools must be used in a pre-determined sequence. The first tool utilized is spring compressor 40 in the form of a thin blade that includes a rectangular handle 42 and a key blank section 44 having a tumbler camming surface 45 formed on the end thereof. The other end of the key blank section terminates in a shoulder 46 which controls the depth the key blank section is inserted into a lock cylinder. An alignment notch 48 is cut in handle 42. When key blank section 44 is inserted in the keyway of a lock cylinder it forces all the tumblers to a radially outward position and compresses springs 24, as illustrated in FIG. 9.

A spring retainer tool 50 shown in FIG. 5 functions to retain springs 24 in a compressed position but leaves tumblers 22 free to move after spring compressor tool 40 is removed from the keyway. To accomplish this, tool 50 and tool 40 must both be inserted into the lock keyway at the same time. FIGS. 4*a* and 5*a* illustrate the relative thicknesses of the two tools, however, the thickness of tool 50 is exaggerated in FIG. 5*a* for purposes of clarity. Tool 50 includes a rectangular handle formed by L-shaped member 52, a side bar 54 which is mounted inwardly so as to form a guide surface 53 all along the lower side of the rectangular handle. A positioning slide 56 is slideably mounted in a space provided between the long side of member 52 and side plate 54. A spring retaining section 58 has one end thereof mounted to the handle by means of pins 60 and the other end of the section 58 terminates in a plurality of comb-like projections 62. The comb-like projections are spaced one from another so that when the tool is inserted into the lock cylinder the projections will straddle the tumblers and leave them free for movement but will engage the springs 24 and retain them in a compressed position. Positioning slide 56 slides back and forth in the handle, and has a shoulder 64 formed on one end thereof that when pushed up against the handle causes the slide to be in a position to support the comb-like projections 62. When the slide 56 is pushed into the lock, and projections 62 are worked to touch the wafer springs, the top of slide 56 will touch the top of the keyway, in turn holding the water springs in a compressed position therefore supporting the projections 62. As an example, the dimension of the comb-like projections 62 is 0.240 inches. The dimension to get the projections 62 into the keyway is 0.250 inches. After the projections 62 are worked and the slide 56 is pushed in, both dimensions of 62 and 56 are needed to keep the wafer springs compressed. The positioning slide end that supports the comb-like projections has four tabs formed in the end thereof that are bent outwardly, two one way and two the other way so as to form a V-shaped guideway that keeps the positioning slide underneath section 58. Only two of the tabs, 66 and 68, are shown in FIG. 5. Positioning slide 56 has three boss-like projections 70 formed on the lower surface thereof that engages the keyway when the slide is moved to a position where it supports the comb-like projections 62 in a spring retaining position. The ends of projections 62 that engage the springs 24 each have a dish-shaped configuration 65, see FIG. 5*b*, which prevents the springs from slipping off the projections when the springs are being retained in a compressed condition. Handle 50 has an alignment pin 72 formed thereon which is positioned in the alignment notch 48 formed in tool 40 when the two tools are installed together in the lock cylinder keyway.

FIG. 6 illustrates a tumbler adjusting tool 74 that is installed in the keyway along with tool 50 after tool 40 has been removed. The tool includes a rectangular handle section 75 and a tumbler engaging section 76 that is mounted in the handle by means of pins 78. An alignment notch 79 is also formed in handle 75 and positioned so that when tools 74 and 50 are in the keyway together, alignment pin 72 will be received in alignment slot 79. Pushing downward with tool 74 moves projections 80 to the tumblers. Tumbler grasping section 76 has a plurality of finger-like projections 80 formed on one end thereof that engages the tumblers. Fingers 80, which are thin and flexible so as to have some spring action, each have an enlarged portion 81 formed on the ends thereof, so that the space between the enlarged portions is slightly less than the width of the tumblers. The reason for this is so that the tumblers will be engaged by the fingers with a friction fit, and movement of the fingers will result in movement of the tumblers. A slide bar 82 is slideably mounted in handle 75, and includes a shoulder 84 formed on one end thereof so that when the slide is moved to the position shown in FIG. 6, end section 86 of the slide bar 82 will be in a position to support the finger-like projections in a tumbler-grasping position. One side of section 86 of the slide bar is provided with a keyway engaging surface 88, and the other side of the section 86 has a V-shaped guideway formed by tabs 90 and 92 in the same manner as the V-shaped guideway formed in the positioning slide of the spring retaining tool discussed above. After the tumbler grasping tool is installed in the keyway, slide bar 82 is moved to the position shown in FIG. 6 so as to force the fingers 81 to grasp the tumblers. The locksmith can then manipulate tool 74 in a manner more fully described hereafter so as to align V-notches in the tumblers so that the side bar will enter the V-notches formed in the tumblers and allow movement of the lock cylinder in the outer casing to open the lock.

The tool disclosed in FIG. 7 is a decoding tool that is installed in the keyway together with the spring retaining tool after the tumbler adjusting tool has been removed from the keyway. The purpose of this tool is to measure the position of each tumbler 22 when it is in an opening position and the side bar 28 is in the V-notches 36. The decoding tool includes a rectangular alignment member 94 that is positioned so that its lower surface rests on guide surface 53 of the spring retaining tool. One short side of alignment member 94 is provided with five uniformly spaced notches 96. Six guide holes 98 are formed near the other end of alignment member 94 in a position so that when surface 95 of the alignment member is resting on surface 53, then one of the six guideholes can be positioned on alignment pin 72 in the keyway. A feeling and indicating device 99 is pivotally mounted on the alignment member by means of pin 100. One end of the feeling and indicating device has a pointer 102 formed thereon that is adjacent notches 96 formed in the alignment member 94. The other end of the feeling and indicating device terminates in a feeler 104 that engages the tumblers. A handle 106 is suitably installed on the feeling and indicating device for the locksmith to use when he is imparting feeling motion to the feeling and indicating device. The feeler end is bent at an angle of about 5 degrees, as shown in FIG. 7*a*, so as to position the feeler 104 beneath the tumbler being felt. The guideholes 98 are spaced so that when each one is aligned on alignment pin 72 of the spring retaining tool, the feeler 104 will be positioned so as to engage one of the six tumblers in a General Motor's automobile ignition or door lock.

The lock mechanisms provided in General Motor's automobile doors and trunk lids have dust covers associated therewith that keep dust and moisture out of the lock mechanism. When inserting a key into such a lock mechanism, the key cams the dust cover out of the way thereby giving access to the keyway. However, in picking such a lock, the spring actuated dust cover interferes with the locksmith's feel and dexterity in picking. Therefore, a tool is needed to hold this dust cover out of the way during a picking operation. The tool shown in FIG. 8 is such a tool. The dust cover holding tool consists of a bent piece of thin spring steel having a notch 110 formed in end 112 thereof. End 114 functions as a handle to be grasped by the locksmith. In operation, end 112 is inserted into the bottom of the keyway until notch 110 is aligned with the outer end thereof and then the tool is rotated and pushed down to the bottom of the keyway. In this position, the tool holds the dust cover open and handle 14 is pointed downwardly out of the locksmith's way during the lock picking operation.

Figure 10:
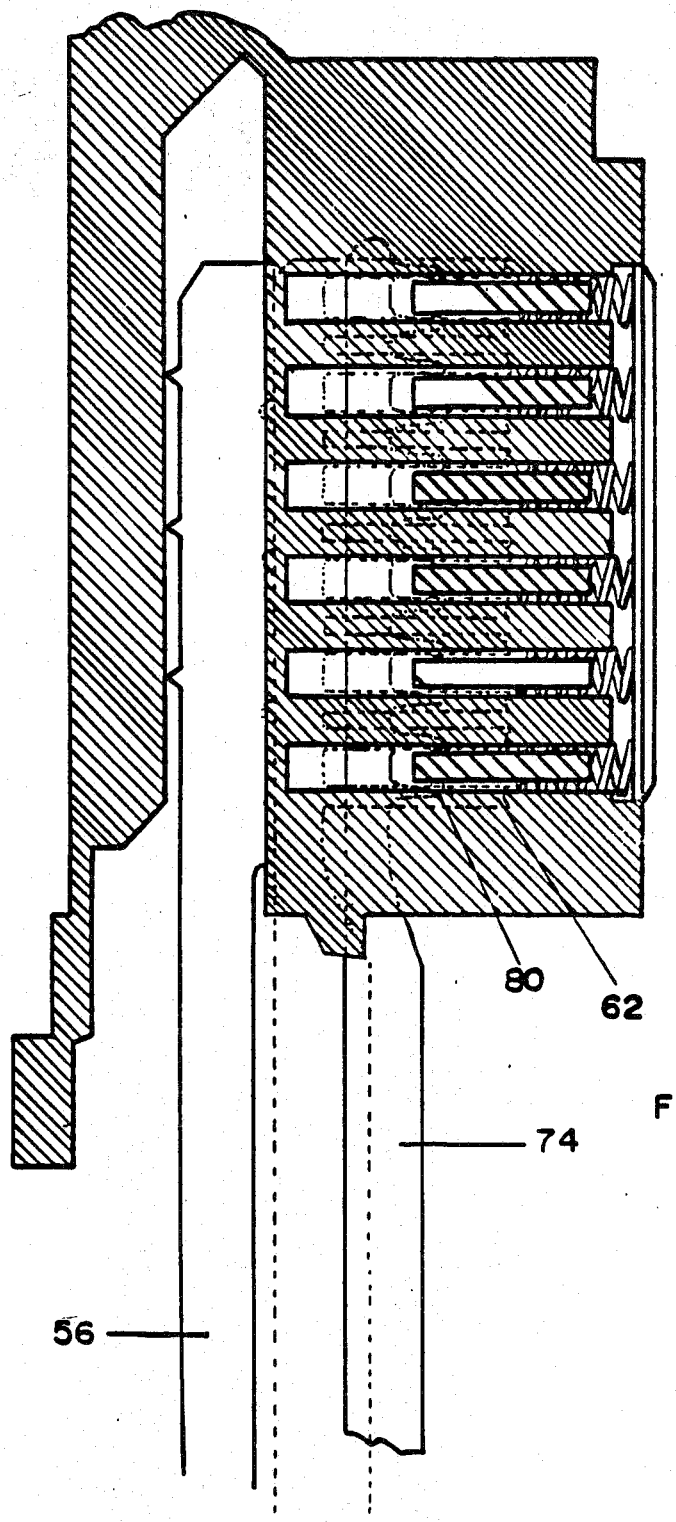
FIG. 10 is a cross-sectional view of a lock cylinder with the spring retainer and the tumbler-grasping instrument positioned therein. The comb-like sections of the spring retainer are shown in engagement with the tumbler springs and the fingers of the tumbler-grasping instrument are grasping the tumblers.
Figure 11:
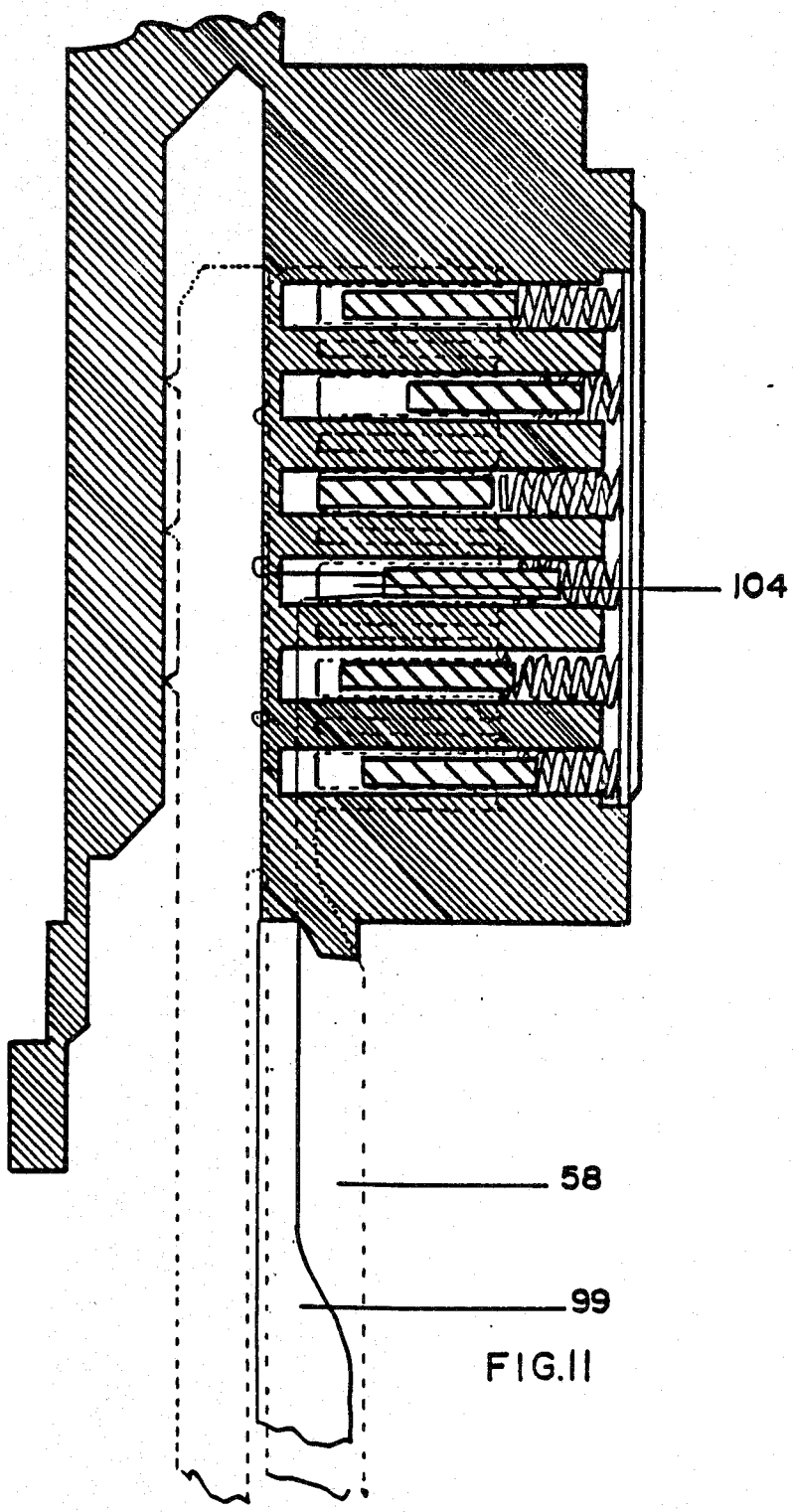
FIG. 11 is a cross-sectional view of a lock cylinder with the spring retainer installed and engaging the tumbler springs, and the decoder tool installed and aligned so that its feeler is engaging the third tumbler from the left of the drawing.

The operation and use of the tool set will now be described while making reference to FIGS. 9, 10, and 11, and assuming that if the lock mechanism to be picked has a dust cover, the dust cover holder tool has been inserted in the keyway as previously described. Key blank section 44 of the spring compressor tool 40 is inserted into the keyway until shoulder 46 engages a shoulder in the lock mechanism, as illustrated in FIG. 9. In this position, all of the tumblers are forced to a radially outward position which compresses springs 24. The spring retainer tool, with the position slide 56 positioned to the left as shown in FIG. 9, is inserted in the keyway over the tumblers, also as shown in FIG. 9 with dotted lines. Positioning slide 56 is then slid to the right to a position like that shown in FIG. 5 and in FIG. 11 so as to move the comb-like projections 62 downwardly over the tumblers in a position to engage and retain springs 24 in a compressed position. Then spring compressor tool 40 is removed from the keyway, and the tumbler-grasping tool 74 is inserted in lieu thereof. During initial installation of the tumbler adjusting tool, slide bar 82 is positioned to the right, as viewed in FIG. 6, so that end section 86 is not under section 76. After the alignment notch 79 is aligned with alignment pin 72, the slide 82 is moved to the left as shown in FIG. 6 to the position shown in FIG. 6 so that the tumbler-grasping fingers 80 of the tool are pushed on the tumblers. This is shown in FIG. 10 although the slide bar 82 is not shown for purposes of clarity. It should be understood that in the position shown in FIG. 10, slide bar 82 would be in a position so that section 86 of the slide bar is over the finger-like projections that grasp the tumblers. Then the handle 75 of the tumbler adjusting tool is rocked gently up and down, with no more than one-half inch of movement of the handle, until the tumblers are all adjusted to a position like that shown in FIG. 3 where the side bar will enter into the tumbler V-notches. Then the lock cylinder can be rotated relative to outer casing 16 to a position like that shown in FIG. 3. The lock is now in an "on" position. The next step is to decode the bittings of a key that will operate the lock.

This is accomplished by removing the tumbler adjusting tool 74 from the lock mechanism and installing the decoder tool in its place. Either the first or last guide-hole 98 is installed on alignment pin 72. This places the feeler 104 under one of the tumblers to be measured. In FIG. 11 of the drawing, the third tumbler from the left side of the lock mechanism is being felt. To accomplish this, the third guide-hole 98 from the left side of the tool, as viewed in FIG. 7, would be positioned on alignment pin 72. When installed, the locksmith then moves the handle 106 up and down gently several times until he is sure that he has the end 104 resting against the tumbler, as shown in FIG. 11. He then determines which of the notches 96 are aligned with the pointer 102. This provides him with a number that he can use to set a key machine. After he has felt each of the tumblers, he will have six numbers that can be used to set a key machine and cut a new key for the lock.

This completes the description of the invention, and while a preferred embodiment has been disclosed herein, it will be obvious to those skilled in the art that various changes and modifications thereto may be made without departing from the spirit and scope of this invention as defined in the claims appended hereto.

What is claimed is:

1. A method of opening and decoding the bittings of a side bar lock mechanism utilizing wafer tumblers comprising the steps of:

inserting a first tool in the keyway of the lock mechanism while in a locked condition to engage the tumblers and force them all radially outward to the limit of their travel and thereby compress the springs that normally bias the tumblers inwardly, inserting a second tool in the keyway adjacent said first tool and engaging the springs that normally bias said tumblers inwardly to maintain the springs in a compressed position so that when said first tool is removed, the springs remain compressed and the tumblers are released for movement in the lock mechanism, removing said first tool from the lock mechanism to release the tumblers and inserting a third tool therein for grasping the tumblers and moving them all to a position where the lock mechanism can be adjusted to an open condition, moving said lock mechanism to an open position, removing said third tool therefrom, and inserting a fourth tool in said lock mechanism adjacent said second tool and measuring the radial position of each tumbler in the lock mechanism to obtain information that a locksmith can use to a cut a new key for the lock mechanism.

2. A tool set for picking open a side bar lock mechanism when the key therefor is not available, and decoding the bittings of a key therefor, said lock mechanism including an outer cylindrical casing and a locking cylinder mounted for rotation therein, said lock cylinder having a cavity formed therein that defines a keyway and a plurality of tumbler guideways, each of which guideways has an inwardly spring biased flat tumbler slideably mounted therein so as to normally impinge on and be positioned by a key inserted in said keyway, the inserted key causing V-notches formed in the tumblers to align; the lock cylinder cavity further including a side bar guideway oriented transversely in respect to said tumbler guideways so that an inwardly spring biased side bar slideably mounted in the side bar guideway will slide into the tumbler V-notches when the V-notches are properly positioned by insertion of the key, comprising:

a first spring compressing tool for insertion into the keyway of the lock cylinder to cause radially outward movement of the tumblers slideably mounted therein, the outward movement of the tumblers compressing springs that normally force said tumblers inwardly, a second tool for insertion into said keyway in an aligned position adjacent said first tool, said second tool engaging the springs compressed by said first tool and maintaining the springs in a compressed condition when said first tool is removed from the keyway, thereby removing spring bias from said tumblers and releasing the tumblers for movement, a third tool for insertion into the keyway in an aligned position with respect to said second tool after removal of said first tool for grasping a radially inward end of the released tumblers, whereby the tumblers can be moved in their respective guideways by motion of said third tool to cause the V-notches in the tumblers to align the side bar and allow radially inward movement of the side bar and rotation of the lock cylinder in the outer casing to an open position, a fourth tool to be installed in said keyway in an aligned position adjacent said second tool after the lock is in an open position and said third tool has been removed from the keyway, said fourth tool being adapted to measure the radial distance of each tumbler from the longitudinal axis of the lock cylinder when the lock mechanism is in an open position to provide guide numbers to set a key cutting machine for making a new key that will operate the lock, a fifth tool for holding a dust cover open during picking and decoding operations on lock mechanisms that are provided with spring actuated dust covers that normally close the entrance to a lock mechanism keyway, the said first tool comprising a thin flexible steel blade that has a key blank section of suitable length for the lock to be opened formed on one end thereof, said key blank section forcing the tumblers outwardly when the key blank section is inserted in the keyway, said blade having a handle section formed on the other end thereof that includes an alignment notch cut in one edge thereof for use in aligning said second tool with respect to said first tool, the said second tool comprising a rectangular handle section for holding and manipulating said second tool in opening a lock mechanism, said handle having an alignment pin mounted thereon and a guide surface formed along one long side thereof, an elongated spring retaining section having one end mounted in a fixed position relative to said handle section, the other end of said spring retaining section formed with a plurality of spaced comb-like projections that are spaced to straddle the tumblers and engage the springs biasing said tumblers when the alignment pin on said second tool handle is placed in the alignment notch of a fully inserted first tool, an extendable positioning slide slideably mounted in said handle for sliding movement along said guide surface to a position in the keyway where said slide engages said spring compressing section and supports said comb-like projections in a spring engaging position, and securing means for slideably retaining said positioning slide in said handle.

3. The tool set recited in claim 2 wherein said third tool further includes:

a rectangular handle section for holding and manipulating said third tool to open a lock mechanism, said third tool handle section having a suitably positioned alignment notch formed therein and a guide surface along one long side hereof, a tumbler engaging section having one end fixedly mounted to said third tool handle section and the other end formed into a plurality of finger-like projections spaced for grasping the tumblers, an extendible slide bar slideably mounted in said handle for movement along said third tool guide surface to a position is said keyway where said slide bar means engages the keyway and said tumbler engaging section to move the finger-like projections to a tumbler engaging position, and means for slideably mounting said slide bar means in said handle.

4. The tool set recited in claim 3 wherein said fourth tool further comprises:

a rectangular alignment member having five spaced notches cut in one short end thereof, and six aligned guideholes formed along one long side of said alignment member in a position such that when said fourth tool is inserted into the keyway alongside said second tool, the alignment pin of said second tool can be selectively inserted into any one of the six guideholes, a feeling and indicating device having a pointer formed on one end thereof and a feeler formed on the other end thereof, said feeling and indicating device being pivotally mounted intermediate its ends to said rectangular alignment member and positioned so that when aligned and in operation, said pointer points to one of the five notches formed in said rectangular alignment member and the feeler engages one of the tumblers in a lock cylinder, whereby the biddings of a lock cylinder can be determined by making a tumbler position measurement for each tumbler.

* * * * *